US008648846B2

(12) United States Patent
Toyomura et al.

(10) Patent No.: US 8,648,846 B2
(45) Date of Patent: Feb. 11, 2014

(54) DISPLAY DEVICE, ELECTRONIC DEVICE, AND METHOD OF DRIVING DISPLAY DEVICE

(75) Inventors: Naobumi Toyomura, Kanagawa (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 102 days.

(21) Appl. No.: 13/350,000

(22) Filed: Jan. 13, 2012

(65) Prior Publication Data

US 2012/0133633 A1 May 31, 2012

Related U.S. Application Data

(62) Division of application No. 12/588,605, filed on Oct. 21, 2009, now Pat. No. 8,098,241.

(30) Foreign Application Priority Data

Nov. 12, 2008 (JP) ..... 2008-289674

(51) Int. Cl.
*G09G 5/00* (2006.01)

(52) U.S. Cl.
USPC ..... 345/211; 345/204; 345/212

(58) Field of Classification Search
USPC ..... 345/76–84, 89–100, 204–215, 690
See application file for complete search history.

(56) References Cited

U.S. PATENT DOCUMENTS 5,691,556 A * 11/1997 Saito et al. ..... 257/350
6,008,687 A * 12/1999 Orita et al. ..... 327/515
6,356,026 B1 3/2002 Murto
6,693,388 B2 2/2004 Oomura
7,636,078 B2 * 12/2009 Yamazaki et al. ..... 345/100
7,795,809 B2 * 9/2010 Ito et al. ..... 313/506
2005/0282304 A1 * 12/2005 Inoue et al. ..... 438/29
2006/0007205 A1 * 1/2006 Reddy et al. ..... 345/204
2008/0030119 A1 * 2/2008 Ito et al. ..... 313/483
2008/0030436 A1 2/2008 Iida et al.
2009/0167739 A1 * 7/2009 Tsubata ..... 345/208
2010/0066653 A1 * 3/2010 Yamazaki et al. ..... 345/76

FOREIGN PATENT DOCUMENTS

JP 01-291216 11/1989
JP 2005-165178 A 6/2005

(Continued)

OTHER PUBLICATIONS

Japanese Office Action issued Feb. 5, 2013 for corresponding Japanese Application No. 2008-289674.

*Primary Examiner* — Vijay Shankar
(74) *Attorney, Agent, or Firm* — Rader, Fishman & Grauer PLLC

(57) ABSTRACT

A display device is provided having improved reliability compared with the related art. The display device includes, for each pixel: a photo-emission element and a first MOS transistor connected in series between a first power source line and a second power source line; a capacitor connected to be inserted between a gate and a source of the first MOS transistor; and a second MOS transistor connected to be inserted between a signal line to be applied with a image signal voltage and the gate of the first MOS transistor, the second MOS transistor being controlled by a scan signal to change between ON-state and OFF-state, wherein ON-period of the first transistor is established within a period in which the photo-emission element is maintained to an extinction state and the signal line is applied with a voltage having a fixed level independent from the image signal voltage.

3 Claims, 14 Drawing Sheets

(56) References Cited

FOREIGN PATENT DOCUMENTS

| | | | |
|---|---|---|---|
| JP | 2005-195756 | A | 7/2005 |
| JP | 2008-033193 | A | 2/2008 |
| JP | 2008-241855 | A | 10/2008 |
| JP | 2008-257085 | A | 10/2008 |
| JP | 4605261 | B2 | 1/2011 |
| JP | 4715833 | B2 | 7/2011 |
| WO | WO-2008/032552 | A1 | 3/2008 |

* cited by examiner

DISPLAY DEVICE, ELECTRONIC DEVICE, AND METHOD OF DRIVING DISPLAY DEVICE

CROSS REFERENCES TO RELATED APPLICATIONS

This is a Divisional Application of patent application Ser. No. 12/588,605, filed Oct. 21, 2009, now U.S. Pat. No. 8,098,241, issued Jan. 17, 2012, which claims priority from Japanese Patent Application JP 2008-289674 filed in the Japanese Patent Office on Nov. 12, 2008, the entire contents of which are incorporated herein by reference.

BACKGROUND OF THE INVENTION

1. Field of the Invention

The present invention relates to a display device including a display section having a photo emission element and a pixel circuit for each pixel, and a method of driving the display device, and to an electronic device having such a display device.

2. Description of the Related Art

Recently, in a field of a display device performing image display, a display device is developed and progressively commercialized, which uses a current-drive optical element, for example, an organic EL (Electro Luminescence) element, as a photo emission element of a pixel, emission luminance of the optical element varying depending on a current value.

The organic EL element is a self-luminous element unlike a liquid crystal element. Therefore, a display device using the organic EL element (organic EL display device) does not need a light source (backlight), and therefore the display device is high in visibility of an image, low in power consumption, and high in response speed of an element compared with a liquid crystal display device needing a light source.

In the organic EL display device, a drive method includes a simple (passive) matrix method and an active matrix method as in the liquid crystal display device. The former has a simple structure, but has a difficulty that a large, high-resolution display device is hardly achieved. Therefore, the active matrix method is currently actively developed. In this method, a current flowing into a photo emission element disposed for each pixel is controlled by an active element (typically, TFT (Thin Film Transistor) provided in a drive circuit provided for each photo emission element.

Generally, a current-voltage (I-V) characteristic of the organic EL element is deteriorated with time (aged deterioration). In a pixel circuit for current drive of the organic EL element, when the I-V characteristic of the organic EL element is changed with time, a voltage-dividing ratio of the organic EL element to a drive transistor connected in series to the EL element is changed, and therefore a voltage $V_{gs}$ between a gate and source of the drive transistor is also changed. As a result, since a value of current flowing into the drive transistor is also changed, a value of current flowing into the organic EL element is also changed, and consequently emission luminance is changed in accordance with the current value.

In some cases, a threshold voltage $V_{th}$ or mobility μ of the drive transistor is temporally changed, or the threshold voltage $V_{th}$ or mobility μ varies for each pixel circuit due to variation in manufacturing process. When the threshold voltage $V_{th}$ or mobility μ of the drive transistor varies for each pixel circuit in this way, a value of current flowing into the drive transistor varies for each pixel circuit. Therefore, even if the same voltage is applied to a gate of the drive transistor, emission luminance of the organic EL element may vary, leading to loss in uniformity of a screen.

Thus, a proposal has been made in order to achieve that even if the I-V characteristic of the organic EL element is changed with time, or even if the threshold voltage $V_{th}$ or mobility μ of the drive transistor is changed with time, emission luminance of the organic EL element is kept to a certain luminance without being affected by such change. Specifically, a display device is developed, which incorporates a function of compensating variation in I-V characteristic of the organic EL element, and a function of correcting variation in threshold voltage $V_{th}$ or in mobility μ of the drive transistor (for example, described in Japanese Unexamined Patent Application Publication No. 2008-33193).

SUMMARY OF THE INVENTION

In the Japanese Unexamined Patent Application, Publication No. 2008-33193, not only the drive transistor but also a sampling transistor is provided in a pixel circuit. The sampling transistor is OFF in a period except for a correction period of the threshold voltage $V_{th}$ and a write period of a data signal. In such an OFF state, the transistor is applied with a minus bias voltage (reverse bias voltage) particularly during white display.

It is known that when a minus bias voltage is applied to a transistor, a threshold voltage $V_{th}$ of the transistor is temporally minus-shifted (varies in a negative voltage direction). When a threshold voltage $V_{th}$ of a sampling transistor is minus-shifted, since a turn-on/cutoff point of the transistor is shifted to a lower voltage side, write time is lengthened. This results in a difficulty that temporal reduction in emission current value is accelerated due to such lengthened write time.

In this way, in the related art, temporal reduction in emission current value is disadvantageously accelerated due to lengthened write time caused by variation in $V_{th}$ of the sampling transistor, leading to reliability degradation, and there is a room for improvement.

In view of foregoing, it is desirable to provide a display device and an electronic device, of which the reliability may be improved compared with the related art, and a method of driving the display device.

According to an embodiment of the invention, there is provided a display device including: a display section having a photo-emission element and a pixel circuit for each pixel, the photo-emission element having an anode and a cathode, the pixel circuit having a first transistor, a second transistor and a holding capacitor; and a drive section driving the pixel circuit based on a image signal, the drive section having a first drive section, a second drive section, a third drive section, a control section, a first wiring, a second wiring, a third wiring, and a fourth wiring set to a reference voltage. A gate of the first transistor is connected to the first drive section via the first wiring, a drain or source of the first transistor is connected to the third drive section via the third wiring, one of the drain and source, unconnected to the third drive section, of the first transistor is connected to a gate of the second transistor and to one end of the holding capacitor, a drain or source of the second transistor is connected to the second drive section via the second wiring, one of the drain and source, unconnected to the second drive section, of the second transistor is connected to other end of the holding capacitor and to the anode of the photo-emission element, the cathode of the photo-emission element is connected to the fourth wiring. The first drive section selectively outputs, to the first wiring, a first voltage lower than an ON-voltage of the first transistor, or a second voltage equal to or higher than the ON-voltage of the first transistor. The second drive section selectively outputs, to the second wiring, a third voltage lower than sum of a threshold voltage of the photo-emission element and the reference voltage, or a fourth voltage equal to or higher than the sum of the threshold voltage of the photo-emission element and the reference voltage. The third drive section selectively outputs, to the third wiring, a fifth voltage having a fixed level independent from the image signal, or a sixth voltage having a level based on the image signal. The control section outputs a control signal to the first drive section, the control signal instructing the first drive section to establish ON-period of the first transistor within a period in which voltage of the second wiring is maintained to the third voltage to set the photo-emission element into an extinction state and voltage of the third wiring is maintained to the fifth voltage, the ON-period of the first transistor being defined as a period from a timing at which voltage of the first wiring rises from the first voltage to the second voltage to another timing at which the voltage of the first wiring falls from the second voltage to the first voltage.

An electronic device of an embodiment of the invention has the display device.

According to an embodiment of the invention, there is provided a method of driving a display device comprising steps of: providing a display section including a photo-emission element and a pixel circuit for each pixel, and providing a drive section driving the pixel circuit based on a image signal, the photo-emission element having an anode and a cathode, the pixel circuit having a first transistor, a second transistor and a holding capacitor; connecting a gate of the first transistor to the first wiring, connecting a drain or source of the first transistor to the third wiring, and connecting other one of the drain and source of the first transistor to a gate of the second transistor and to one end of the holding capacitor; connecting a gate of the second transistor to the other one of the drain and source of the first transistor and to the one end of the holding capacitor, connecting a drain or a source of the second transistor to the second wiring, and connecting other one of the drain and source of the second transistor to other end of the holding capacitor and to the anode of the photo-emission element; connecting the cathode of the photo-emission element to the fourth wiring set to a reference voltage; selectively supplying the first wiring with a first voltage lower than ON-voltage of the first transistor or a second voltage equal to or higher than the ON-voltage of the first transistor; selectively supplying the second wiring with a third voltage lower than sum of a threshold voltage of the photo-emission element and the reference voltage or a fourth voltage equal to or higher than the sum of the threshold voltage of the photo-emission element and the reference voltage; and selectively supplying the third wiring with a fifth voltage having a fixed level independent from the image signal, or a sixth voltage having a level based on the image signal. ON-period of the first transistor is established within a period in which voltage of the second wiring is maintained to the third voltage to set the photo-emission element into an extinction state and voltage of the third wiring is maintained to the fifth voltage, the ON-period of the first transistor being defined as a period from a timing at which voltage of the first wiring rises from the first voltage to the second voltage to another timing at which the voltage of the first wiring falls from the second voltage to the first voltage.

According to an embodiment of the invention, there is provided a display device, including for each pixel: a photo-emission element and a first MOS transistor connected in series between a first power source line and a second power source line; a capacitor connected to be inserted between a gate and a source of the first MOS transistor; and a second MOS transistor connected to be inserted between a signal line to be applied with a image signal voltage and the gate of the first MOS transistor, the second MOS transistor being controlled by a scan signal to change between ON-state and OFF-state. ON-period of the first transistor is established within a period in which the photo-emission element is maintained to an extinction state and the signal line is applied with a voltage having a fixed level independent from the image signal voltage.

In the display device, the electronic device, and the method of driving the display device of an embodiment of the invention, the control signal instructs the first drive section to establish ON-period of the first transistor within a period in which voltage of the second wiring is maintained to the third voltage to set the photo-emission element into an extinction state and voltage of the third wiring is maintained to the fifth voltage, the ON-period of the first transistor being defined as a period from a timing at which voltage of the first wiring rises from the first voltage to the second voltage to another timing at which the voltage of the first wiring falls from the second voltage to the first voltage. This accelerates plus shift (variation in a positive voltage direction) of $V_{th}$ (threshold voltage) of the first transistor, enabling cancel of a variation level of minus shift (variation in a negative voltage direction) of $V_{th}$ (threshold voltage) of the first transistor in the past. Therefore, variation in $V_{th}$ of the first transistor is suppressed, which suppresses acceleration in temporal reduction in light emission current value due to lengthened write time caused by such variation in $V_{th}$.

According to the display device, the electronic device, and the method of driving the display device of an embodiment of the invention, the control signal instructs the first drive section to establish ON-period of the first transistor within a period in which voltage of the second wiring is maintained to the third voltage to set the photo-emission element into an extinction state and voltage of the third wiring is maintained to the fifth voltage, the ON-period of the first transistor being defined as a period from a timing at which voltage of the first wiring rises from the first voltage to the second voltage to another timing at which the voltage of the first wiring falls from the second voltage to the first voltage. Therefore variation in $V_{th}$ of the first transistor is suppressed, and consequently acceleration in temporal reduction in light emission current value may be suppressed. Accordingly, reliability may be improved compared with the related art.

Other and further objects, features and advantages of the invention will appear more fully from the following description.

DETAILED DESCRIPTION OF THE PREFERRED EMBODIMENT

Hereinafter, a preferred embodiment of the invention will be described in detail with reference to drawings.

Example of Entire Configuration of Display Device

Figure 1:
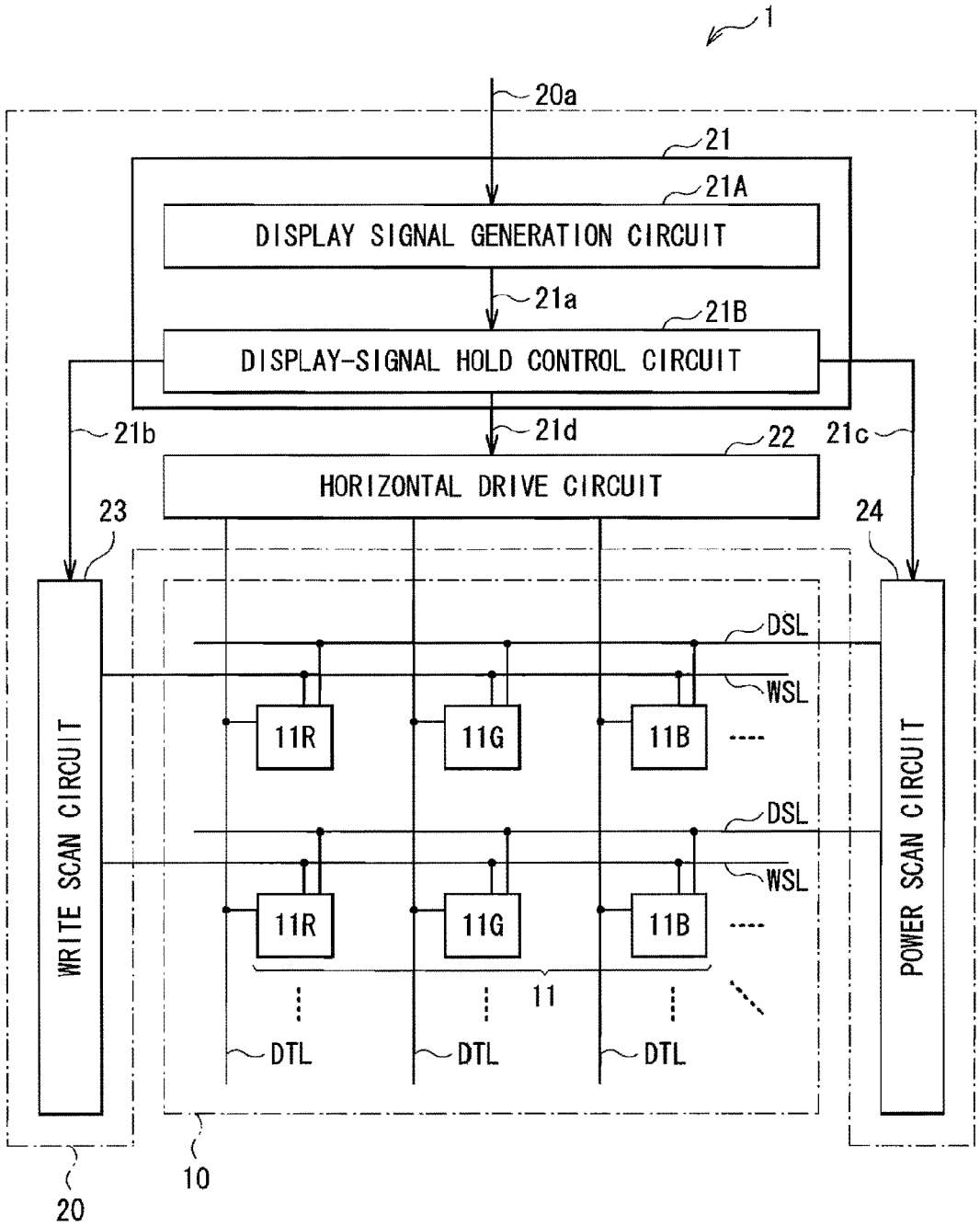
FIG. 1 is a block diagram showing an example of a display device according to an embodiment of the invention.

FIG. 1 shows an example of an entire configuration of a display device 1 according to an embodiment of the invention. The display device 1 has a display section 10 and a peripheral circuit section 20 (drive section) formed in the periphery of the display section 10 on a substrate (not shown) including, for example, glass, a silicon (Si) wafer, or resin.

The display section 10 includes a plurality of pixels 11 arranged in a matrix pattern over the whole surface of the display section 10, and displays an image based on an externally inputted video signal 20*a* by active matrix drive. Each pixel 11 includes a red pixel 11R, a green pixel 11G and a blue pixel 11B.

Figure 2:
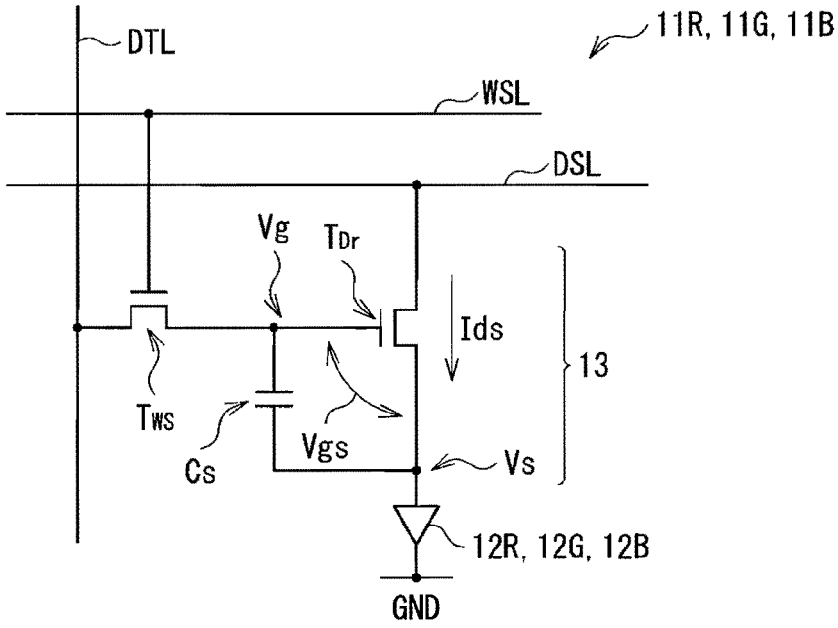
FIG. 2 is a configurational diagram showing an example of an internal configuration of a pixel in FIG. 1.

FIG. 2 shows an example of an internal configuration of a pixel 11R, 11G or 11B. An organic EL element 12R, 12G or 12B (photo-emission element) and a pixel circuit 13 are provided in the pixel 11R, 11G or 11B respectively.

For example, the organic EL element 12R, 12G or 12B (hereinafter, called organic EL element 12R or the like) has, while not shown, a configuration where an anode, an organic layer and a cathode are stacked in order from a substrate side. The organic layer has, for example, a stacked structure where a hole injection layer improving hole injection efficiency, a hole transport layer improving hole transport efficiency to a light emitting layer, the light emitting layer emitting light induced by recombination of an electron and a hole, and an electron transport layer improving electron transport efficiency to the light emitting layer are stacked in order from an anode side.

The pixel circuit 13 includes a sampling transistor $T_{ws}$ (first transistor), a retention volume Cs, and a drive transistor $T_{Dr}$ (second transistor), that is, has a 2Tr1C circuit configuration. The transistor $T_{ws}$ or $T_{Dr}$ is, for example, formed of an n-channel MOS thin film transistor (TFT).

The peripheral circuit section 20 has a timing control circuit 21 (control section), a horizontal drive circuit 22 (third drive section), a write scan circuit 23 (first drive section), and a power scan circuit 24 (second drive section). The timing control circuit 21 includes a display signal generation circuit 21A and a display-signal hold control circuit 21B. Moreover, the peripheral circuit section 20 has gate lines WSL (first wirings), drain lines DSL (second wirings), signal lines DTL (third wirings), and ground lines GND (fourth wirings). The ground lines GND are connected to ground, and thus set to ground voltage (reference voltage).

The display signal generation circuit 21A generates a display signal 21*a* for displaying an image on the display section 10, for example, for each picture (for each field display) based on the externally inputted video signal 20*a*.

The display-signal hold control circuit 21B stores the display signal 21*a* outputted from the display signal generation circuit 21A for each picture (for each field display) into a field memory including SRAM (Static Random Access Memory) or the like and holds the signal therein. In addition, the display-signal hold control circuit 21B controls the horizontal drive circuit 22 driving each pixel 11, the write scan circuit 23, and the power scan circuit 24 such that the circuits operate in an interlocked manner. Specifically, the display-signal hold control circuit 21B outputs a control signal 21*b* to the write scan circuit 23, outputs a control signal 21*c* to the power scan circuit 24, and outputs a control signal 21*d* to the horizontal drive circuit 22.

The horizontal drive circuit 22 may output two kinds of voltages ($V_{ofs}$ (fifth voltage) and $V_{sig}$ (sixth voltage)) corresponding to the control signal 21*d* outputted from the display-signal hold control circuit 21B. Specifically, the horizontal drive circuit 22 supplies the two kinds of voltages ($V_{ofs}$ and $V_{sig}$) to a pixel 11 selected by the write scan circuit 23 via a signal line DTL connected to each pixel 11 of the display section 10.

$V_{sig}$ has a voltage value corresponding to the video signal 20*a*. The lowest voltage of $V_{sig}$ has a low voltage value compared with $V_{ofs}$, and the highest voltage of $V_{sig}$ has a high voltage value compared with $V_{ofs}$.

The write scan circuit 23 may output two kinds of voltages ($V_{on}$ (second voltage) and $V_{off}$ (first voltage)) corresponding to the control signal 21*b* outputted from the display-signal hold control circuit 21B. Specifically, the write scan circuit 23 supplies the two kinds of voltages ($V_{on}$ and $V_{off}$) to a pixel 11 as a drive object via a gate line WSL connected to each pixel 11 of the display section 10 so as to control the sampling transistor $T_{ws}$.

$V_{on}$ has a value equal to or higher than a value of ON voltage of the transistor $T_{ws}$. $V_{on}$ has a value of voltage outputted from the write scan circuit 23 in a $V_{th}$ correction preparatory period, a $V_{th}$ correction period, or a write/μ correction period, each period being described later. $V_{off}$ has a value lower than a value of ON voltage of the transistor $T_{ws}$, and lower than the value of $V_{on}$. $V_{off}$ has a value of voltage outputted from the write scan circuit 23 in the $V_{th}$ correction preparatory period, a $V_{th}$ correction suspension period, or a light emission period, each period being described later.

The power scan circuit 24 may output two kinds of voltages ($V_{ini}$ (third voltage) and $V_{cc}$ (fourth voltage)) corresponding to the control signal 21*c* outputted from the display-signal hold control circuit 21B. Specifically, the power scan circuit 24 supplies the two kinds of voltages ($V_{ini}$ and $V_{cc}$) to a pixel 11 as a drive object via a drain line DSL connected to each pixel 11 of the display section 10 so as to control light emission of the organic EL element 12R or the like and extinction of the light.

$V_{ini}$ has a value of voltage lower than the total voltage ($V_{el}+V_{ca}$) of a threshold voltage $V_{el}$ of the organic EL element 12R or the like and a cathode voltage $V_{ca}$ thereof. Vcc has a value of voltage equal to or higher than the voltage ($V_{el}+V_{ca}$).

Next, a connection relationship between the components is described with reference to FIG. 2. Each gate line WSL led from the write scan circuit 23 is formed extendedly in a row direction, and connected to a gate of the transistor $T_{ws}$. Each drain line DSL led from the power scan circuit 24 is also formed extendedly in a row direction, and connected to a drain of the transistor $T_{Dr}$. Each signal line DTL led from the horizontal drive circuit 22 is formed extendedly in a column direction, and connected to a source of the transistor $T_{ws}$. A drain of the transistor $T_{ws}$ is connected to a gate of the drive transistor $T_{Dr}$ and to one end of the retention volume $C_s$, and a source of the transistor $T_{Dr}$ and the other end of the retention volume $C_s$ are connected to an anode of the organic EL element 12R or the like respectively. A cathode of the organic EL element 12R or the like is connected to the ground line GND.

Operation and Effects of Display Device

Next, operation and effects of the display device 1 of the embodiment will be described.

In the display device 1, the peripheral circuit section 20 performs ON/OFF control of a pixel circuit 13 of each pixel 11 as shown in FIGS. 1 and 2. Thus, a drive current is injected into an organic EL element 12R or the like of each pixel 11, and thus a hole and an electron are recombined, inducing light emission. The emitted light is multiply reflected between an anode and a cathode, and then extracted to the outside through the cathode and the like. As a result, an image based on the video signal 20*a* is displayed on the display section 10.

Here, operation of a display device in the past according to a comparative example will be described together with difficulties of the display device with reference to FIGS. 3 to 8.

Figure 3:
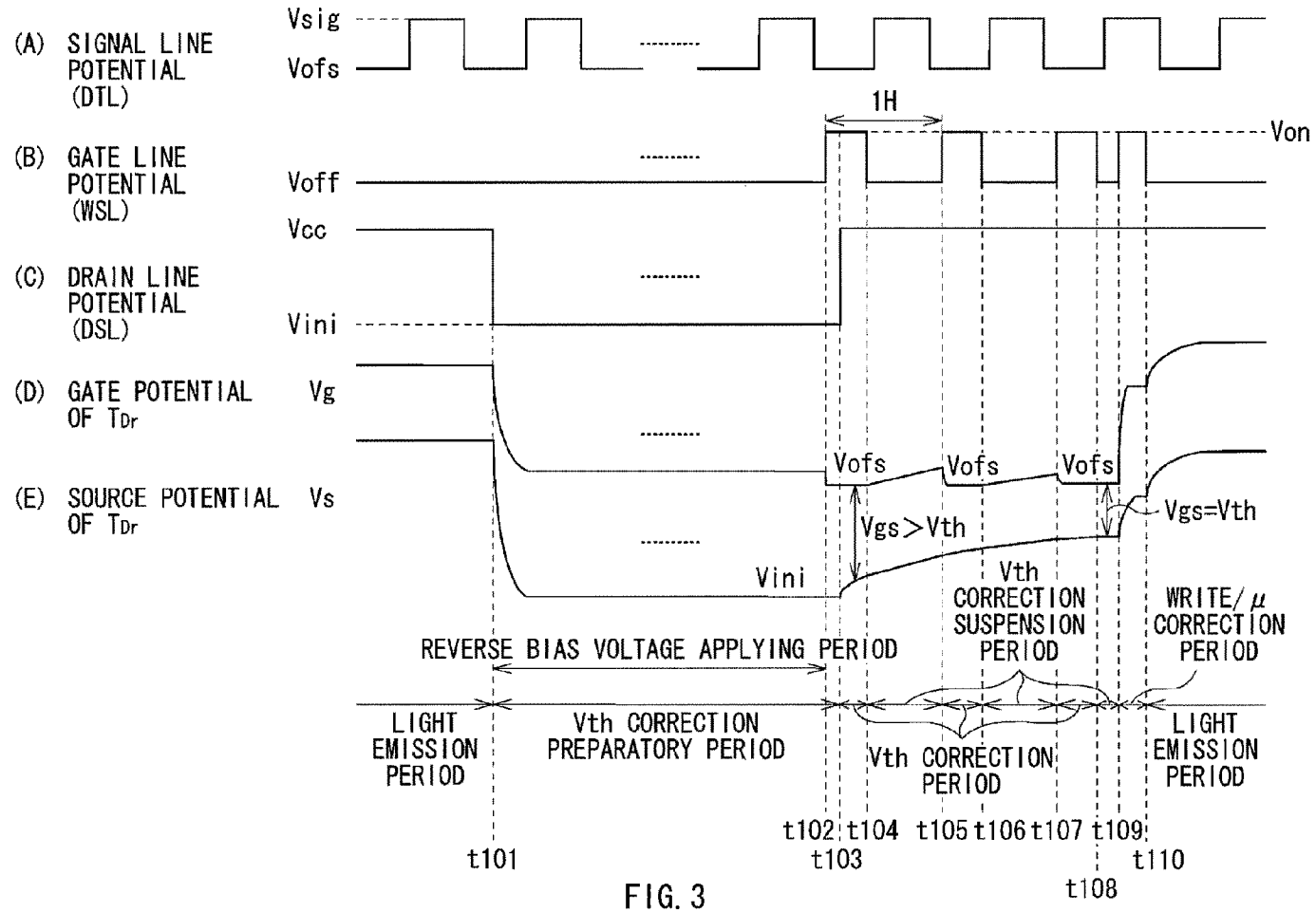
FIG. 3 RELATED ART
FIG. 3 is waveform diagrams for illustrating an example of operation of a display device according to a comparative example.

FIG. 3 shows an example of various waveforms appearing in the display device according to the comparative example. FIG. 3 shows an aspect where the gate line WSL is applied with the two kinds of voltages ($V_{on}$ and $V_{off}$ ($<V_{on}$)), the drain line DSL is applied with the two kinds of voltages ($V_{cc}$ and $V_{ini}$ ($<V_{cc}$)), and the signal line DTL is applied with the two kinds of voltages ($V_{sig}$ and $V_{ofs}$ ($<V_{sig}$)). Furthermore, FIG. 3 shows an aspect where gate voltage $V_g$ and source voltage $V_s$ of the transistor $T_{Dr}$ change every moment in response to a voltage applied to each of the gate line WSL, the drain line DSL, and the signal line DTL.

$V_{th}$ Correction Preparatory Period

First, preparation of $V_{th}$ correction is performed in a period of timing t101 to timing t103 in the figure. Specifically, first, the power scan circuit 24 lowers the voltage of the drain line DSL from $V_{cc}$ to $V_{ini}$ (timing t101). Thus, the source voltage $V_s$ is lowered to $V_{ini}$, and thus light emitted from the organic EL element 12R or the like is extinguished. At that time, the gate voltage $V_g$ is also lowered due to coupling of the gate and the source via the retention volume $C_s$. Then, in a period where a voltage of the signal line DTL is $V_{ofs}$, the write scan circuit 23 raises a voltage of the gate line WSL from $V_{off}$ to $V_{on}$ (timing t102). Thus, the gate voltage $V_g$ is lowered to $V_{ofs}$. The period of timing t101 to timing t102 corresponds to a period of applying reverse-bias voltage to the transistor $T_{ws}$ as will be described later.

First $V_{th}$ Correction Period

Next, $V_{th}$ correction is performed in a period of timing t103 to timing t104 in the figure. Specifically, in a period where a voltage of the signal line DTL is $V_{ofs}$, the power scan circuit 24 raises the voltage of the drain line DSL from $V_{ini}$ to $V_{cc}$ (timing t103). Thus, a current $I_{ds}$ flows between the drain and the source of the transistor $T_{Dr}$, and thus the source voltage $V_s$ is raised. Then, before the horizontal drive circuit 22 changes the voltage of the signal line DTL from $V_{ofs}$ to $V_{sig}$, the write scan circuit 23 lowers the voltage of the gate line WSL from $V_{on}$ to $V_{off}$ (timing t104). Thus, the gate of the transistor $T_{Dr}$ is turned into floating, so that the correction of $V_{th}$ is temporarily stopped.

First $V_{th}$ Correction Suspension Period

In a period where the first $V_{th}$ correction is suspended (timing t104 to timing t105), sampling of a voltage of the signal line DTL is performed in a row (pixel) different from a row (pixel) subjected to the previous $V_{th}$ correction. When the $V_{th}$ correction is insufficient, the current $I_{ds}$ flows between the drain and source of the transistor $T_{Dr}$ in the row (pixel) subjected to the previous $V_{th}$ correction even during the $V_{th}$ correction suspension period. That is, when a voltage difference $V_{gs}$ between the gate and source of the transistor $T_{Dr}$ is larger than the threshold voltage $V_{th}$ of the transistor $T_{Dr}$, the current $I_{ds}$ flows between the drain and source of the transistor $T_{Dr}$ in the row (pixel) subjected to the previous $V_{th}$ correction even during the $V_{th}$ correction suspension period. Thus, the source voltage V, is raised, and the gate voltage $V_g$ is also raised due to coupling of the gate and the source via the retention volume $C_s$.

Second $V_{th}$ Correction Suspension Period

After the first $V_{th}$ correction suspension period is finished, $V_{th}$ correction is performed again in a period of timing t105 to timing t106 in the figure. Specifically, when the voltage of the signal line DTL is $V_{ofs}$, and therefore $V_{th}$ correction is enabled, the write scan circuit 23 raises the voltage of the gate line WSL from $V_{off}$ to $V_{on}$ (timing t105), so that the gate of the transistor $T_{Dr}$ is connected to the signal line DTL. At that time, when the source voltage $V_s$ is lower than ($V_{ofs}-V_{th}$) (when $V_{th}$ correction is not completed yet), the current $I_{ds}$ flows between the drain and source of the transistor $T_{Dr}$ until the transistor $T_{Dr}$ is cut off (until the voltage difference $V_{gs}$ corresponds to $V_{th}$). As a result, the retention volume C, is charged to $V_{th}$, and the voltage difference $V_{gs}$ becomes $V_{th}$. Then, before the horizontal drive circuit 22 changes the voltage of the signal line DTL from $V_{ofs}$ to $V_{sig}$, the write scan circuit 23 lowers the voltage of the gate line WSL from $V_{on}$, to $V_{off}$ (timing t106). Thus, since the gate of the transistor $T_{Dr}$ is turned into floating, the voltage difference $V_g$, may be kept to $V_{th}$ regardless of a voltage level. The voltage difference $V_g$, is set to $V_{th}$ in this way, thereby even if the threshold voltage $V_{th}$ of the transistor $T_{Dr}$ varies for each pixel circuit 13, variation in emission luminance of the organic EL element 12R or the like may be eliminated.

Second $V_{th}$ Correction Suspension Period

Then, $V_{th}$ correction is suspended again in a period of timing t106 to timing t107 in the figure in the same way as the first $V_{th}$ correction suspension period.

Third $V_{th}$ Correction Period and Third $V_{th}$ Correction Suspension Period Then, third $V_{th}$ correction is performed in a period of timing t107 to timing t108, and $V_{th}$ correction is suspended in a period of timing t108 to timing t109 in the same way as the first and second $V_{th}$ correction. The horizontal drive circuit 22 changes the voltage of the signal line DTL from $V_{ofs}$ to $V_{sig}$ during the third $V_{th}$ correction suspension period.

Write/μ Correction Period

After the $V_{th}$ correction suspension period is finished, write and μ correction are performed in a period of timing t109 to timing t110 in the figure. Specifically, in a period where the voltage of the signal line DTL is $V_{sig}$, the write scan circuit 23 raises the voltage of the gate line WSL from \$T_{off}$ to $V_{on}$ (timing t109), so that the gate of the transistor $T_{Dr}$ is connected to the signal line DTL. Thus, gate voltage of the transistor $T_{Dr}$ becomes $V_{sig}$. Anode voltage of the organic EL element 12R or the like is still lower than the threshold voltage $V_{el}$ of the organic EL element 12R or the like, and therefore the organic EL element 12R or the like is cut off. Therefore, the current $I_{ds}$ flows into element capacitance (not shown) of the organic EL element 12R or the like, so that the element capacitance is charged, and therefore the source voltage $V_s$ is raised by ΔV, and eventually the voltage difference $V_{gs}$ becomes $(V_{sig}+V_{th}-\Delta V)$. In this way, μ correction is performed concurrently with write. Since ΔV is increased with increase in mobility μ of the transistor $T_{Dr}$, the voltage difference $V_{gs}$ is reduced by ΔV and then light emission is performed, variation in mobility μ for each pixel may be removed.

Light Emission

Finally, the write scan circuit 23 lowers the voltage of the gate line WSL from $V_{on}$ to $V_{off}$ (timing t110). Thus, the gate of the transistor $T_{Dr}$ is turned into floating, so that the current $I_{ds}$ flows between the drain and source of the transistor $T_{Dr}$, and the source voltage $V_s$ is raised. As a result, the organic EL element 12R or the like emits light with desired luminance.

Here, an operation state of the transistor $T_{ws}$ is pointed in the above drive operation. The transistor $T_{ws}$ is OFF in any period other than the $V_{th}$ correction periods (timing t103 to timing t104, timing t105 to timing t106, and timing t107 to timing t108) and the write/μ correction period (timing t109 to timing t110).

Figure 4:
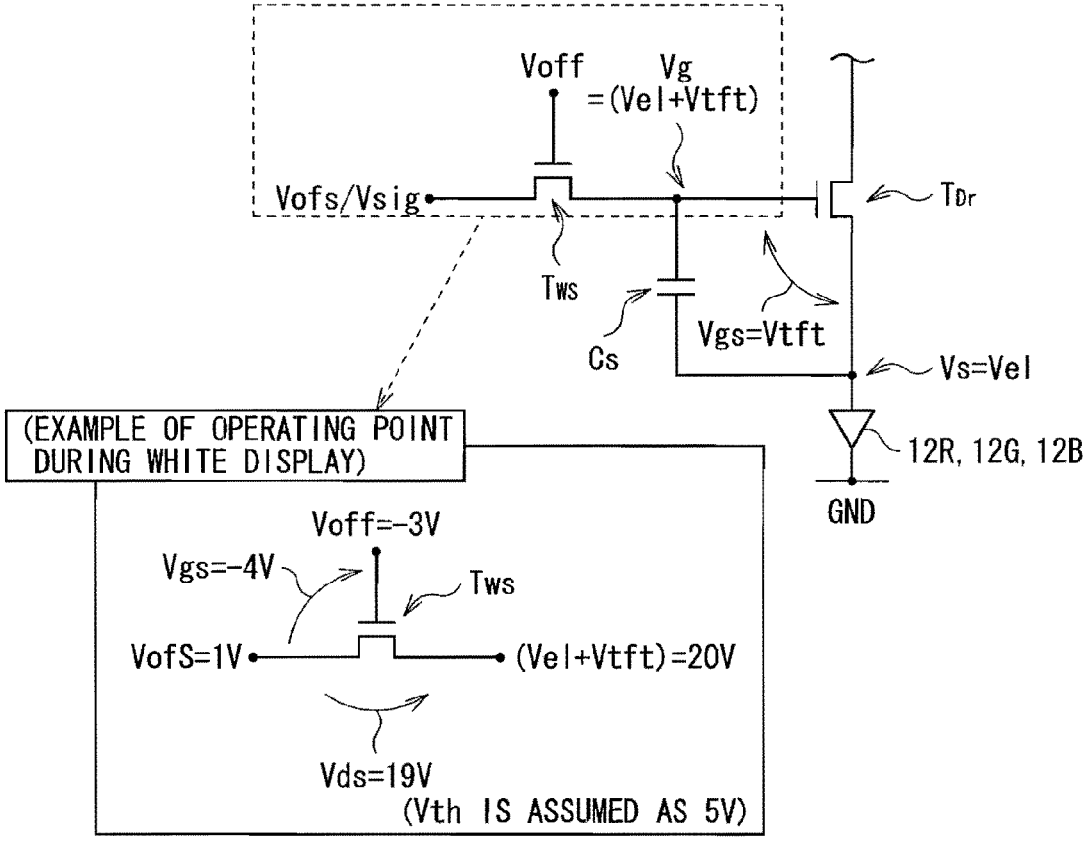
FIG. 4 RELATED ART
FIG. 4 is a circuit diagram showing an example of an operating point of a transistor during white display of the display device according to the comparative example.

FIG. 4 shows an example of an operating point when the transistor $T_{ws}$ is OFF (during white display). In the transistor $T_{ws}$ during such white display, for example, $V_{gs}=(V_{off}-V_{ofs})=-4V$ and $V_{ds}=(V_{el}+V_{th})-V_{ofs}=19V$ are given for the operating point, so that minus bias voltage (reverse bias voltage) is applied to the transistor $T_{ws}$. Here, a threshold voltage $V_{th}$ of the transistor $T_{ws}$ is assumed as 5V.

Figure 5:
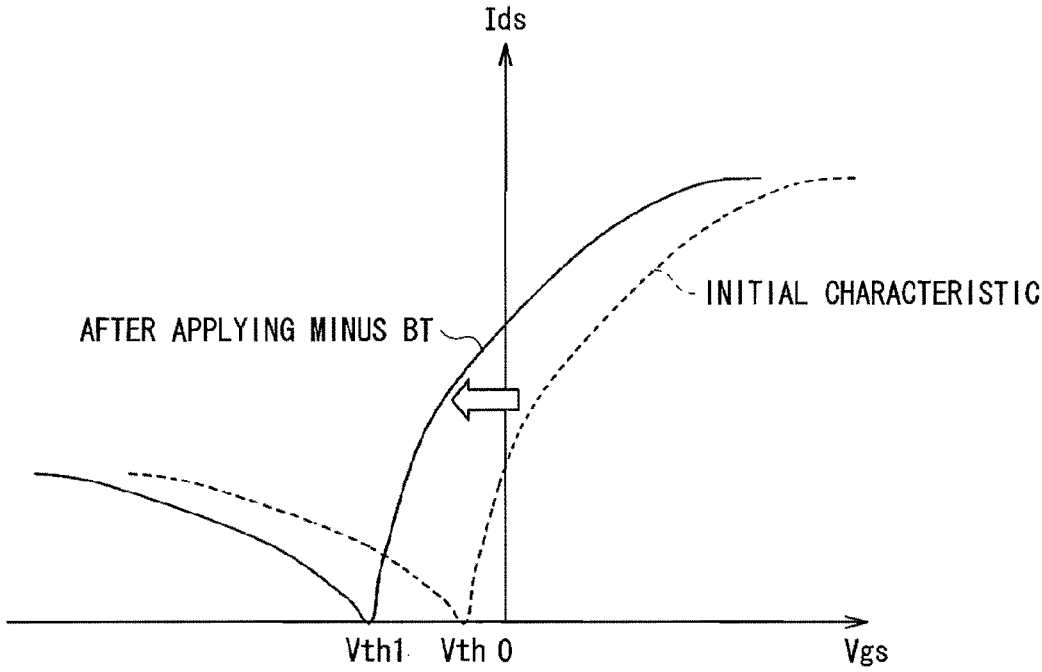
FIG. 5 RELATED ART
FIG. 5 is a characteristic diagram for illustrating minus shift of a transistor characteristic of the display device according to the comparative example.
Figure 6:
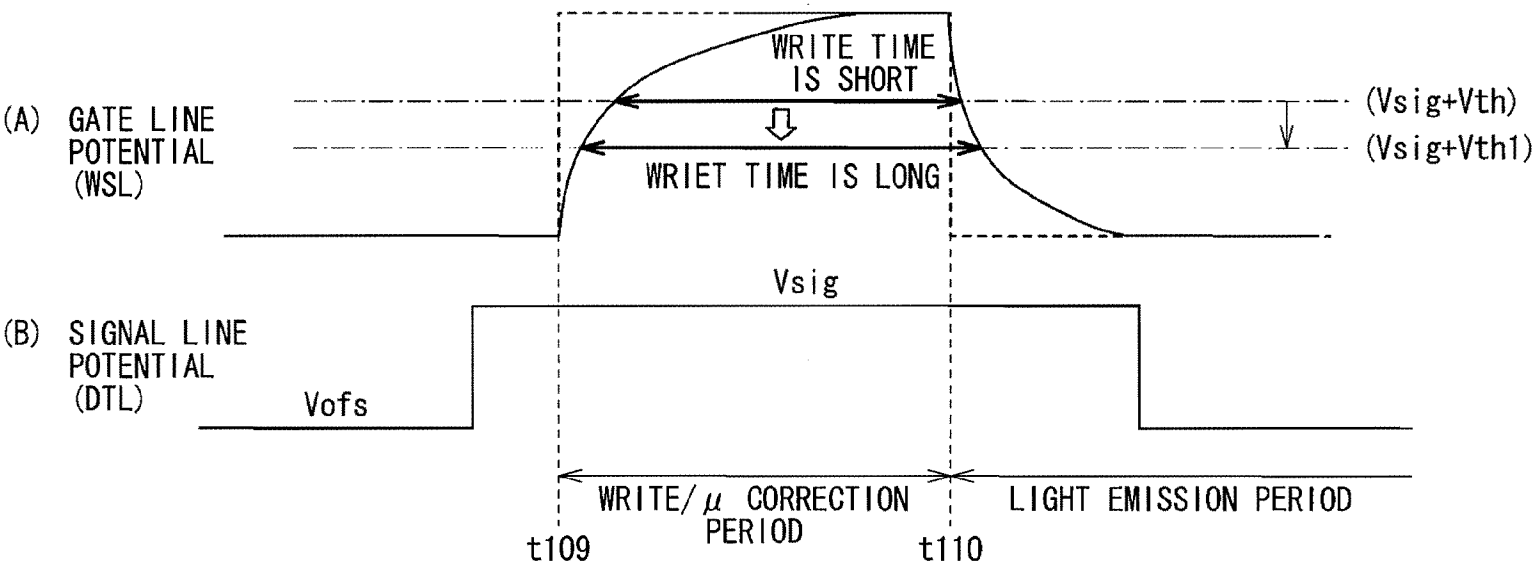
FIG. 6 RELATED ART
FIG. 6 is waveform diagrams for illustrating signal write time in the display device according to the comparative example.
Figure 7:
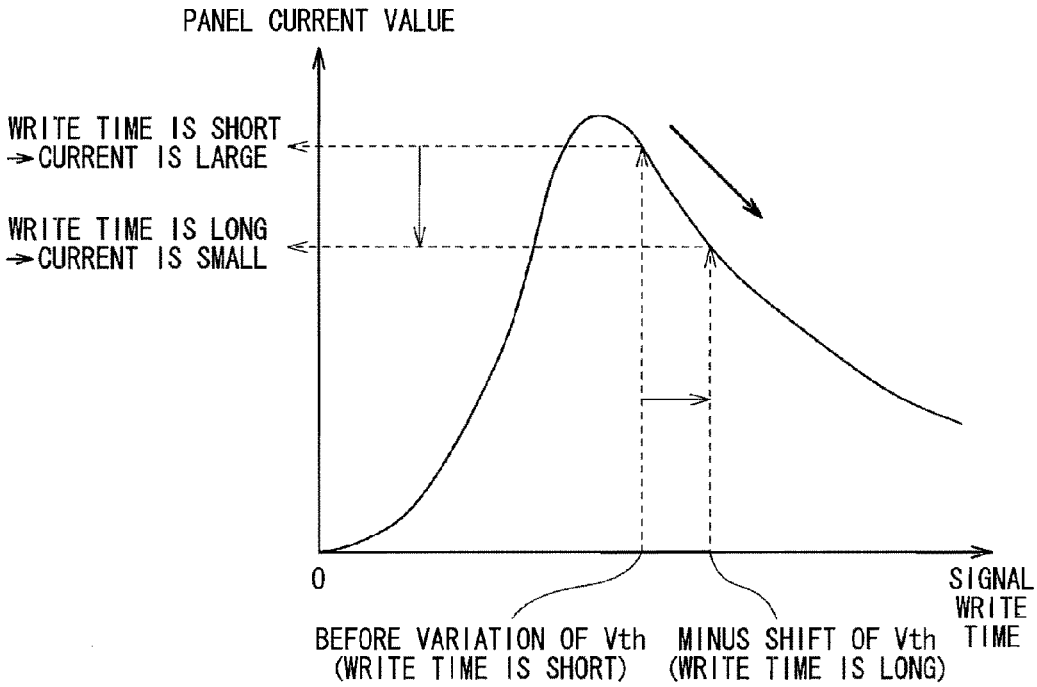
FIG. 7 RELATED ART
FIG. 7 is a characteristic diagram for illustrating a relationship between signal write time and a panel current value in the display device according to the comparative example.
Figure 8:
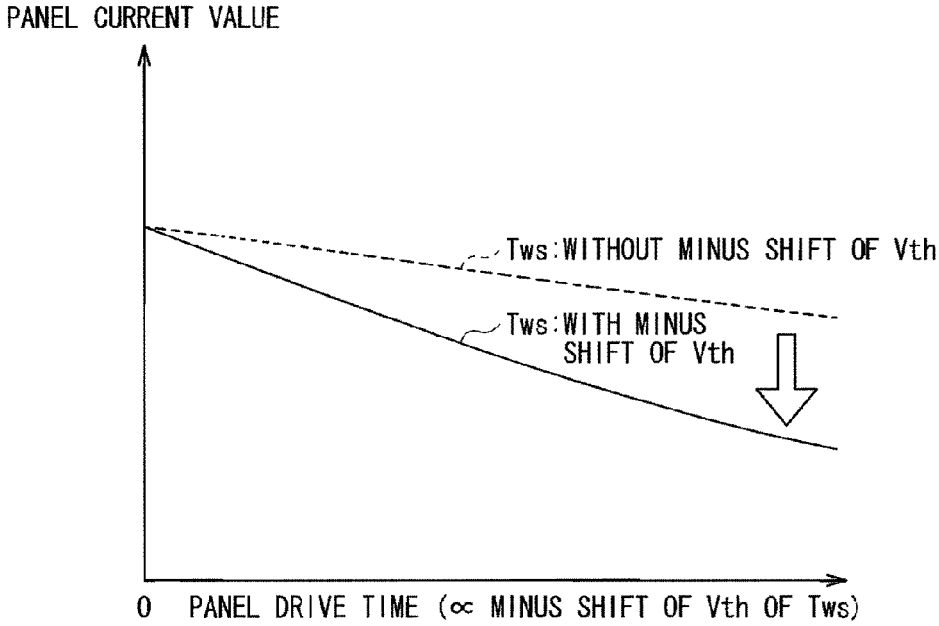
FIG. 8 RELATED ART
FIG. 8 is a characteristic diagram for illustrating a relationship between panel drive time and a panel current value in the display device according to the comparative example.

When such an operating point becomes dominant in the transistor $T_{ws}$ (when minus bias is applied), the threshold voltage $V_{th}$ of the transistor $T_{ws}$ is temporally minus-shifted (varied in a negative voltage direction), for example, as shown in FIG. 5. When the threshold voltage $V_{th}$ of the transistor $T_{ws}$ is minus-shifted (the threshold voltage is assumed as $V_{th1}$ in such a case), since the turn-on/cutoff point of the transistor $T_{ws}$ is shifted to a lower voltage side, write time is lengthened, for example, as shown in FIG. 6. As a result, temporal reduction in light-emission current value (panel current value) is accelerated due to such lengthened write time, for example, as shown in FIGS. 7 and 8.

In this way, in the display device in the past according to the comparative example, temporal reduction in light-emission current value is accelerated due to the lengthened write time caused by variation in $V_{th}$ of the transistor $T_{ws}$, causing reduction in reliability.

Thus, detailed operation of the display device 1 of the embodiment will be then described with reference to FIGS. 9 to 11.

Figure 9:
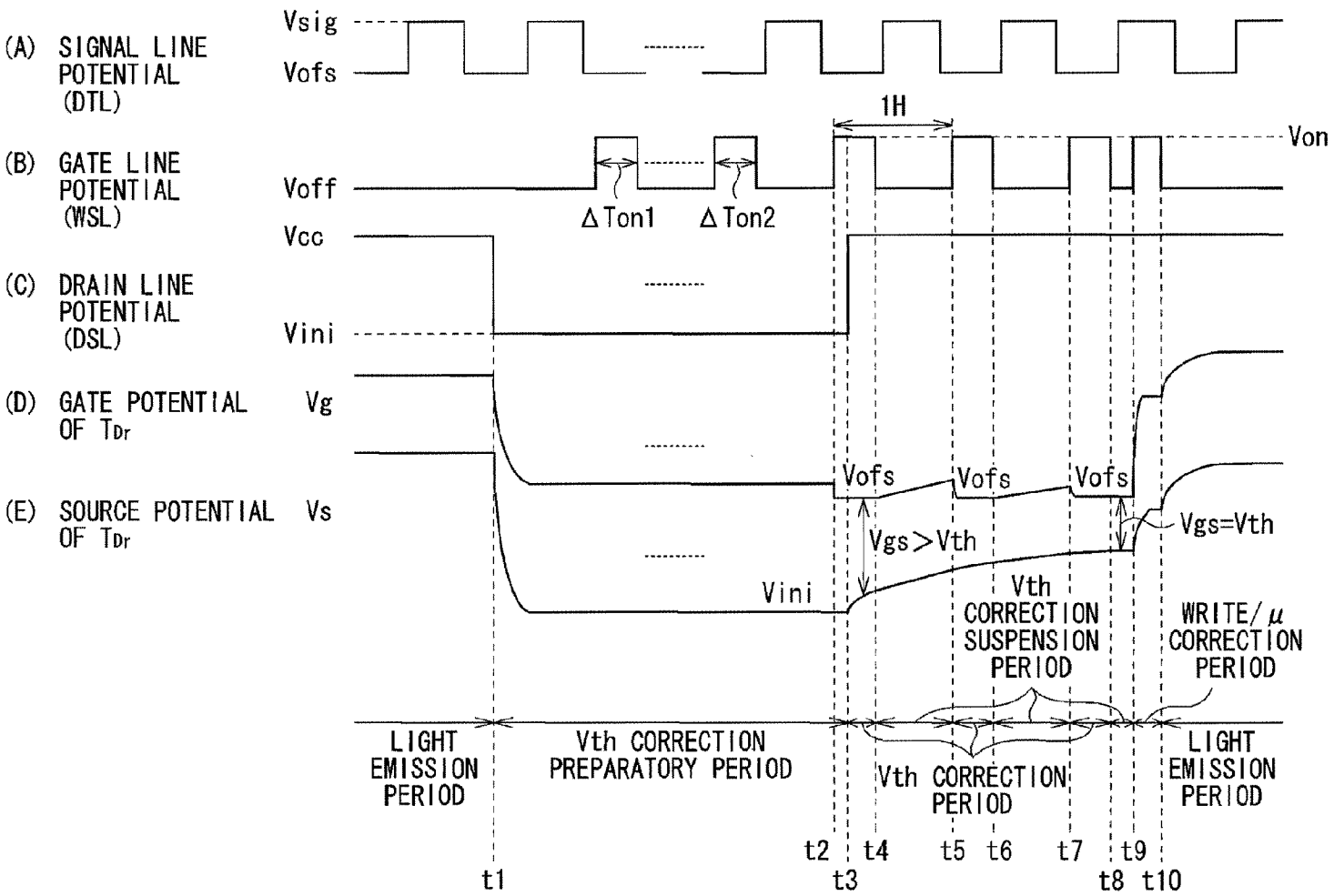
FIG. 9 is waveform diagrams for illustrating an example of operation of a display device according to the embodiment.
Figure 10:
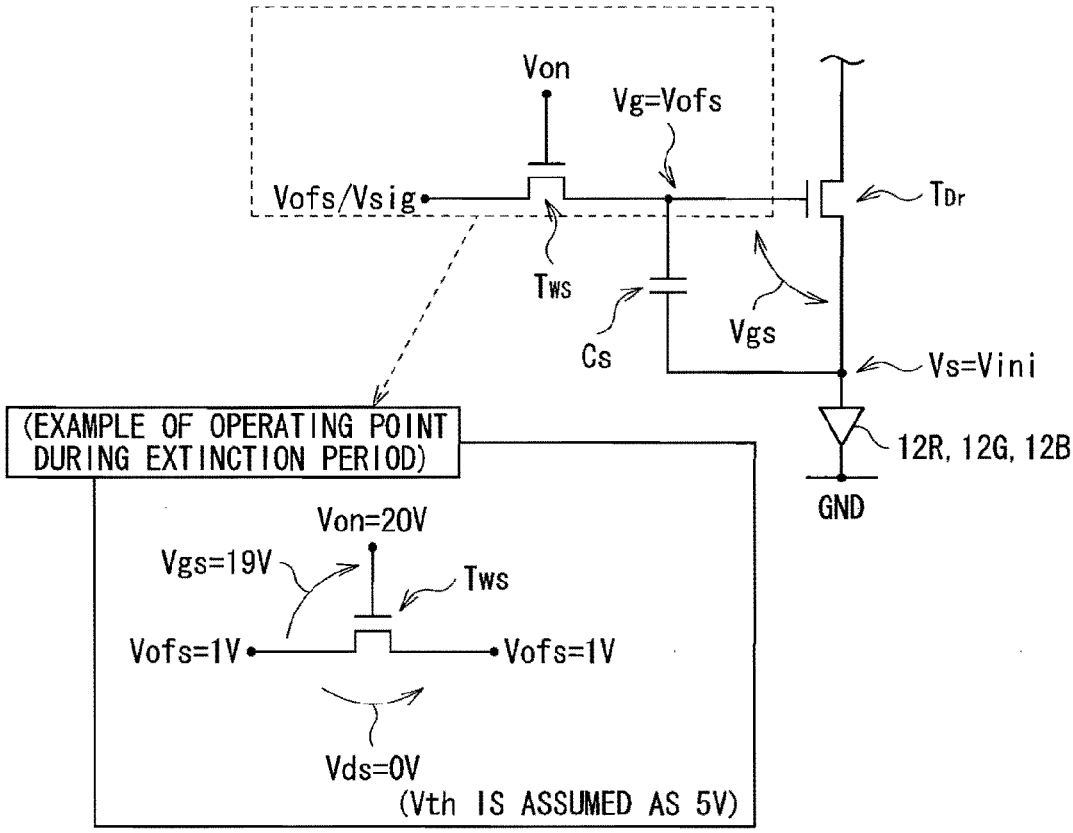
FIG. 10 is a circuit diagram showing an example of an operating point of a transistor during an extinction period of the display device shown in FIG. 1.

FIG. 9 shows an example of various waveforms appearing in the display device 1. FIG. 9 shows an aspect where the gate line WSL is applied with two kinds of voltages ($V_{on}$ and $V_{off}$ ($<V_{on}$)), the drain line DSL is applied with two kinds of voltages ($V_{cc}$ and $V_{ini}$ ($<V_{cc}$)), and the signal line DTL is applied with two kinds of voltages ($V_{sig}$ and $V_{ofs}$ ($<V_{sig}$)). Furthermore, FIG. 9 shows an aspect where gate voltage $V_g$ and source voltage $V_s$ of the transistor $T_{Dr}$ vary every moment respectively. Timing t1 to timing t10 shown in FIG. 9 corresponds to timing t100 to timing t110 in the comparative example shown in FIG. 3.

In the embodiment, as shown in FIG. 9, when voltage of the signal line DTL is $V_{ofs}$ during an extinction period in which voltage of the drain line DSL is $V_{ini}$ (specifically, a $V_{th}$ correction preparatory period of timing t1 to timing t3), the following operation is performed. That is, in such a case, voltage of the gate line WSL is raised from $V_{off}$ to $V_{on}$, and then lowered from $V_{on}$ to $V_{off}$, so that an ON period (for example, an ON period $\Delta T_{on1}$ or $\Delta T_{on2}$ in the figure) is provided. In this case, for example, $V_{gs}=(V_{on}-V_{ofs})=19V$ and $V_{ds}=V_{ofs}-V_{ofs}=0V$ are given for an operating point during the extinction period of the transistor $T_{ws}$, that is, plus bias voltage (forward bias voltage) is applied to the transistor, for example, as shown in FIG. 10.

Figure 11:
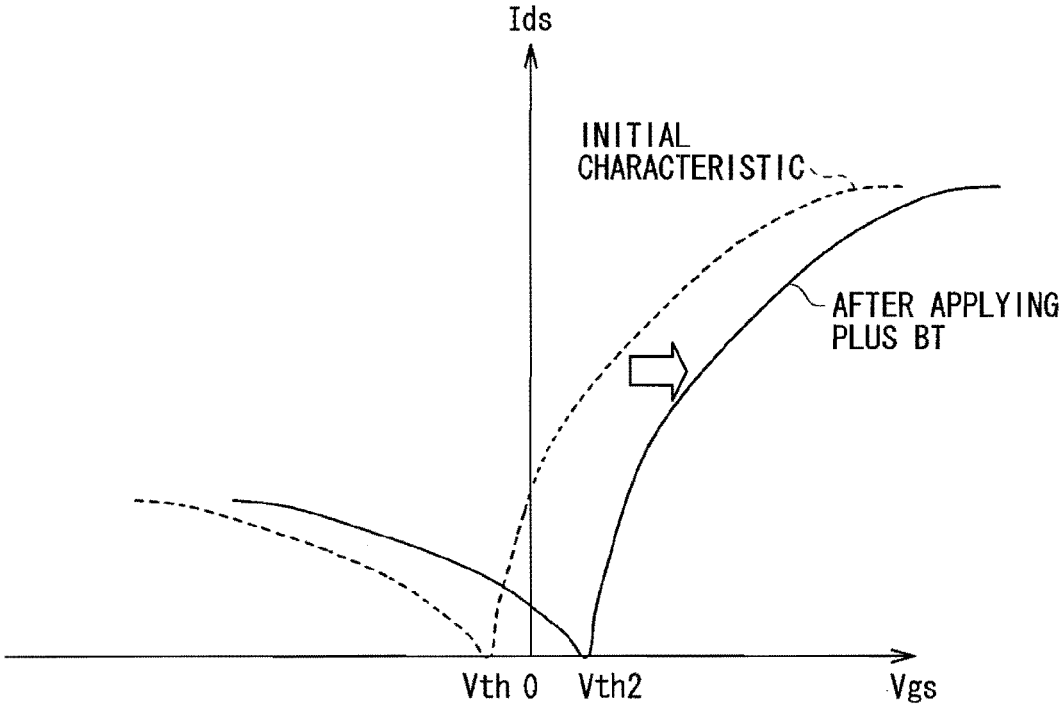
FIG. 11 is a characteristic diagram for illustrating plus shift of a transistor characteristic of the display device shown in FIG. 1.

Thus, for example, as shown in FIG. 11, plus shift (variation in a positive voltage direction) of a threshold value $V_{th}$ of a transistor $T_{ws}$ is accelerated (threshold voltage after the variation is assumed as $V_{th2}$). This resultantly enables cancelling a variation level of minus shift (variation in a negative voltage direction) of the threshold value $V_{th}$ of the transistor $T_{ws}$ in the past. Therefore, variation in $V_{th}$ of the transistor $T_{ws}$ is suppressed, leading to suppression of acceleration in temporal reduction in light emission current value (panel current value) due to lengthened write time caused by such variation in $V_{th}$.

As hereinbefore, in the embodiment, when the voltage of the signal line DTL is $V_{ofs}$ during the extinction period in which the voltage of the drain line DSL is $V_{ini}$, the voltage of the gate line WSL is raised from $V_{off}$ to $V_{on}$, and then lowered from $V_{on}$ to $V_{off}$, so that an ON period $\Delta T_{on1}$ or $\Delta T_{on2}$ is provided. Therefore, variation in $V_{th}$ of the transistor $T_{ws}$ is suppressed, and consequently acceleration in temporal reduction in light emission current value may be suppressed. Accordingly, reliability may be improved compared with the related art.

In addition, for example, when at least one of number of ON periods to be provided, such as $\Delta T_{on1}$ and $\Delta T_{on2}$ shown in FIG. 9, and length of each ON period is adjusted, the amount of plus shift of the threshold value $V_{th}$ of the transistor $T_{ws}$ may be adjusted. Accordingly, the amount of minus shift may be completely cancelled, and consequently reliability may be further improved.

MODULE AND APPLICATION EXAMPLES

Hereinafter, description is made on application examples of the display device 1 described in the embodiment. The display device 1 of the embodiment may be applied to an electronic device in any filed, including a television device, a digital camera, a notebook personal computer, a mobile terminal device such as mobile phone, or a video camera. In other words, the display device 1 of the embodiment may be applied to a display device of an electronic device in any filed, the display device displaying an externally inputted video signal or an internally produced video signal in a form of a still or moving image.

Module

Figure 12:
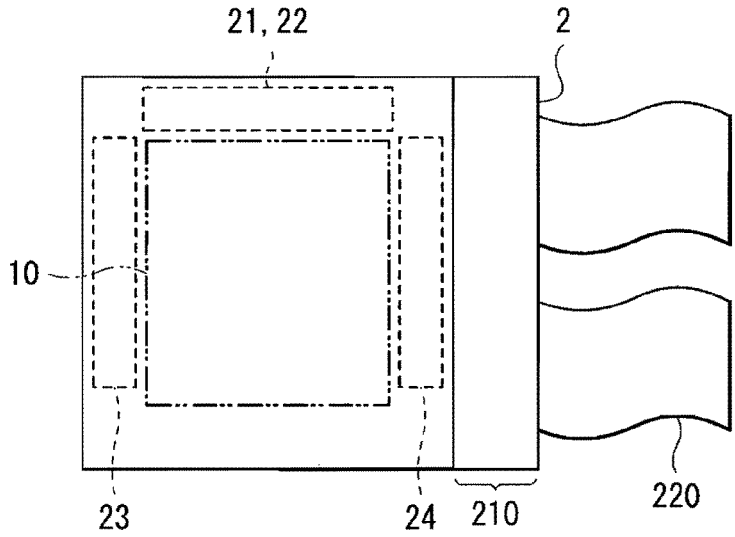
FIG. 12 is a plan view showing a schematic configuration of a module including the display device of the embodiment.

The display device 1 of the embodiment is incorporated in various electronic devices such as application examples 1 to 5 described later, for example, in a form of a module as shown in FIG. 12. The module has, for example, a region 210 exposed from a member (not shown) sealing the display section 10 on one side of the substrate 2. External connection terminals (not shown), which correspond to extensions of wirings of the timing control circuit 21, a horizontal drive circuit 22, a write scan circuit 23, and a power scan circuit 24 respectively, are formed on the exposed region 210. A flexible printed circuit (FPC) 220 for inputting or outputting a signal may be provided on the external connection terminals.

Application Example 1

Figure 13:
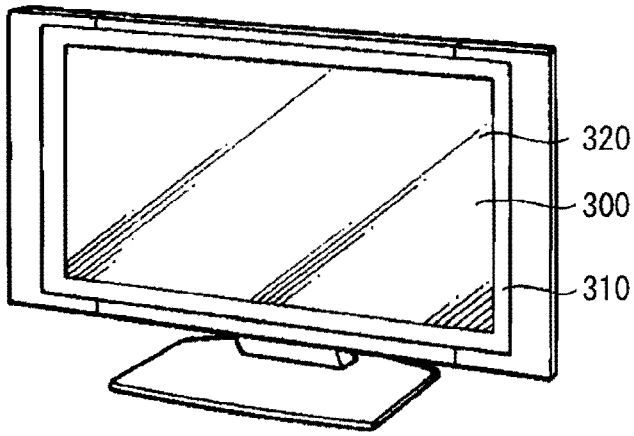
FIG. 13 is a perspective view showing appearance of application example 1 of the display device of the embodiment.

FIG. 13 shows appearance of a television device using the display device 1 of the embodiment. The television device has, for example, a video display screen section 300 including a front panel 310 and a filter glass 320, and the section 300 includes the display device 1 according to the embodiment.

Application Example 2

Figure 14A:
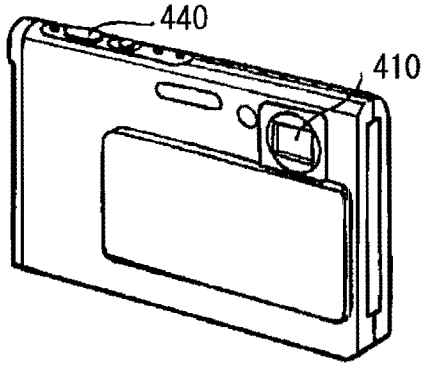
FIG. 14A is a perspective view showing appearance of application example 2 as viewed from a front side.
Figure 14B:
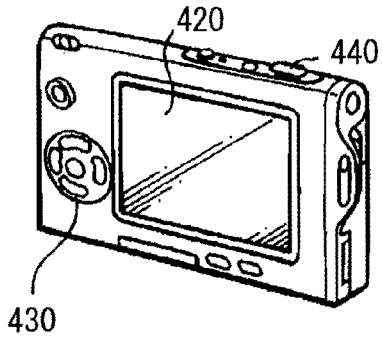
FIG. 14B is a perspective view showing appearance thereof as viewed from a back side.

FIGS. 14A and 14B show appearance of a digital camera using the display device 1 of the embodiment. The digital camera has, for example, a flash light emission section 410, a display section 420, a menu switch 430, and a shutter button 440, and the display section 420 includes the display device 1 according to the embodiment.

Application Example 3

Figure 15:
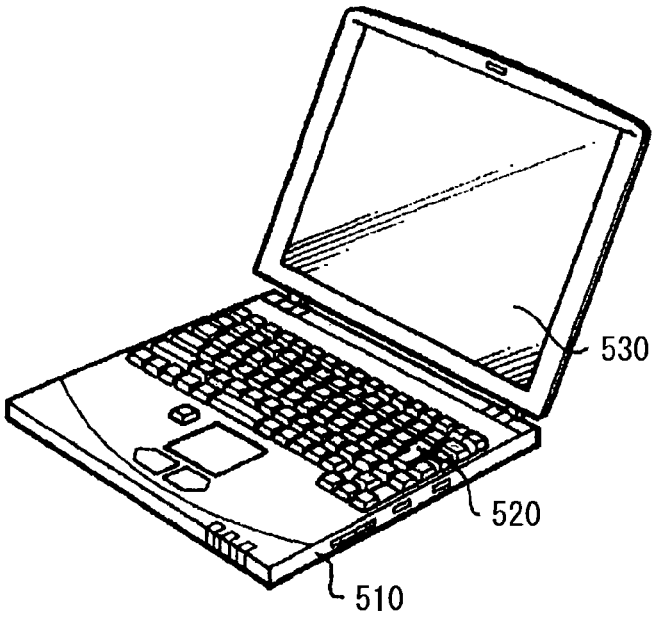
FIG. 15 is a perspective view showing appearance of application example 3.

FIG. 15 shows appearance of a notebook personal computer using the display device 1 of the embodiment. The notebook personal computer has, for example, a body 510, a keyboard 520 for input operation of letters and the like, and a display section 530 for displaying an image, and the display section 530 includes the display device 1 according to the embodiment.

Application Example 4

Figure 16:
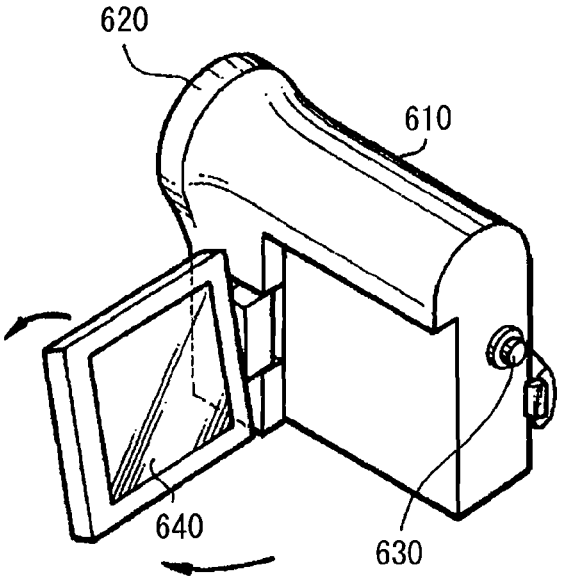
FIG. 16 is a perspective view showing appearance of application example 4.
Figures 17A, 17B, 17C, 17D, 17E, 17F, 17G:
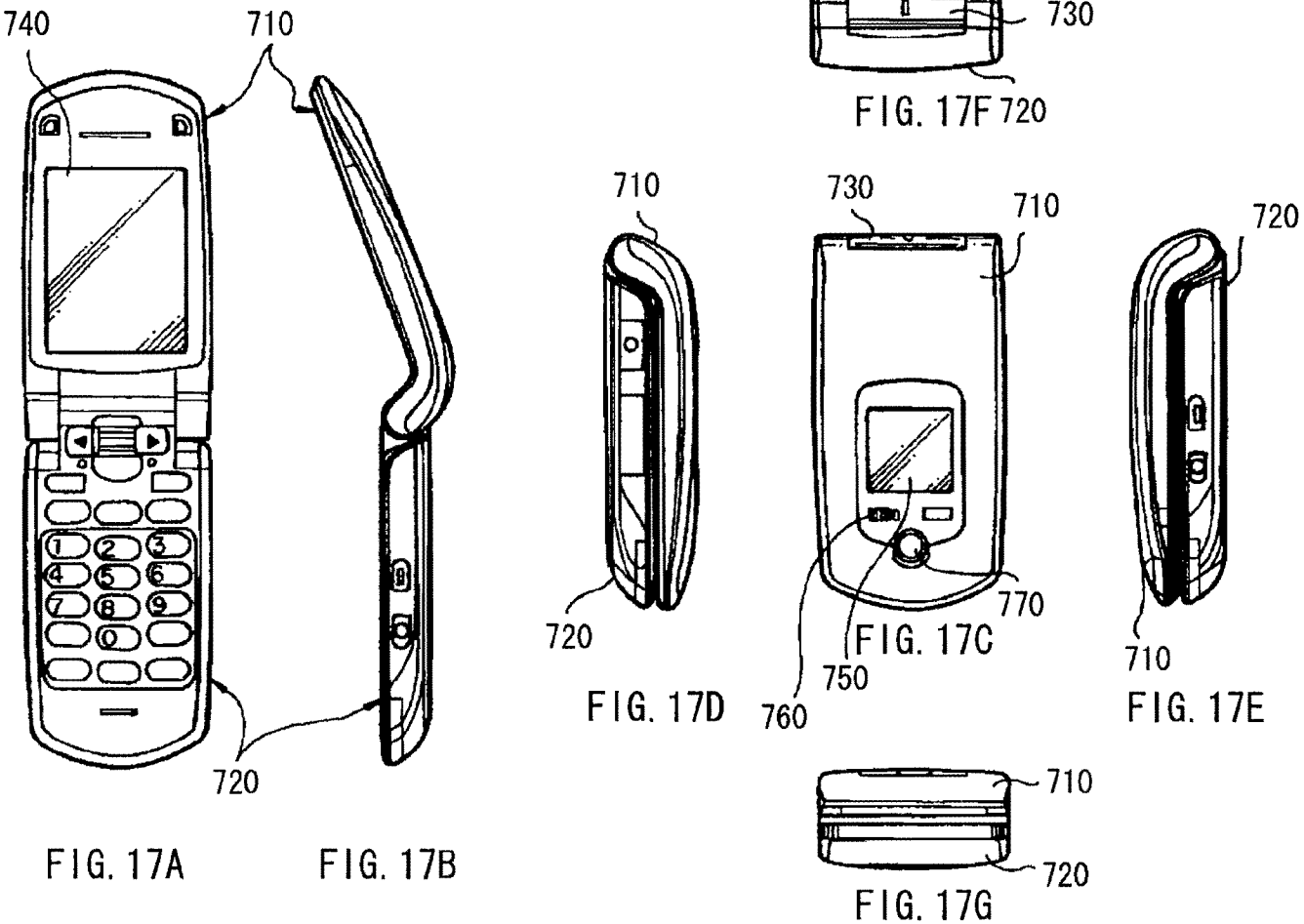
FIG. 17A is a front view of application example 5 in an opened state.
FIG. 17B is a side view thereof.
FIG. 17C is a front view of the application example 5 in a closed state.
FIG. 17D is a left side view thereof.
FIG. 17E is a right side view thereof.
FIG. 17F is a top view thereof.
FIG. 17G is a bottom view thereof.

FIG. 16 shows appearance of a video camera using the display device 1 of the embodiment. The video camera has, for example, a body section 610, an object-photographing lens 620 provided in a front side face of the body section 610, a photographing start/stop switch 630, and a display section 640, and the display section 640 includes the display device 1 according to the embodiment.

Application Example 5

FIGS. 17A to 17G are views showing appearance of a mobile phone using the display device 1 of the embodiment. The mobile phone includes, for example, an upper housing 710 and a lower housing 720, the housings being connected by a connection section (hinge) 730, and has a display 740, a sub-display 750, a picture light 760, and a camera 770. The display 740 or the sub-display 750 includes the display device 1 according to the embodiment.

While the invention has been described with the embodiments and the application examples hereinbefore, the invention is not limited to the embodiments and the like, and may be variously modified or altered.

For example, while the embodiments and the like are described with a case where the display device 1 is an active matrix device, a configuration of the pixel circuit 13 for active matrix drive is not limited to that described in the embodiments and the like. For example, a capacitance element or a transistor may be added to the pixel circuit 13 according to demand. In such a case, a necessary drive circuit may be added in addition to the horizontal drive circuit 22, the write scan circuit 23, and the power scan circuit 24 depending on alteration in pixel circuit 13.

While the display-signal hold control circuit 21B controls drive of each of the horizontal drive circuit 22, the write scan circuit 23, and the power scan circuit 24 in the embodiments and the like, another circuit may control the drive of each circuit. Moreover, control of the horizontal drive circuit 22, write scan circuit 23, or power scan circuit 24 may be performed by hardware (a circuit) or by software (a program).

Furthermore, while the embodiments and the like are described with the organic EL element 12R or the like as an example of a photo-emission element, the invention may be applied to another photo-emission element such as LED (Light Emitting Diode).

It should be understood by those skilled in the art that various modifications, combinations, sub-combinations and alterations may occur depending on design requirements and other factors insofar as they are within the scope of the appended claims or the equivalent thereof.

What is claimed is:

1. A display device, comprising for each pixel:

a photo-emission element and a first MOS transistor connected in series between a first power source line and a second power source line;

a capacitor connected between a gate and a source of the first MOS transistor; and a second MOS transistor connected between a signal line and the gate of the first MOS transistor, the second MOS transistor being controlled by a scan signal that changes between an ON-state and an OFF-state, wherein an ON-period of the first MOS transistor is established within a period in which the photo-emission element is maintained to a non-light emission state and the signal line is applied with a voltage having a fixed level independent from an image signal voltage that is otherwise applied to an image signal line, and wherein the ON-period of the first MOS transistor is provided by raising a voltage of the scan signal from Voff to Von and then lowering the voltage of the scan signal from Von to Voff.

2. The display device of claim 1, wherein the ON-period of the first MOS transistor is one of a plurality of ON-periods.

3. The display device of claim 2, wherein a length of each ON-period is adjustable.

* * * * *